US007258247B2

(12) United States Patent
Marquez

(10) Patent No.: US 7,258,247 B2
(45) Date of Patent: Aug. 21, 2007

(54) AUTOMATED CONDIMENT DISPENSING SYSTEM

(75) Inventor: Al H. Marquez, San Jose, CA (US)

(73) Assignee: Expense Management, Inc., Carson City, NV (US)

( * ) Notice: Subject to any disclaimer, the term of this patent is extended or adjusted under 35 U.S.C. 154(b) by 363 days.

(21) Appl. No.: 10/792,134

(22) Filed: Mar. 2, 2004

(65) Prior Publication Data

US 2005/0194396 A1 Sep. 8, 2005

(51) Int. Cl.
*G07F 11/00* (2006.01)

(52) U.S. Cl. ..... 221/2; 221/21; 221/124; 221/126; 221/93; 221/94

(58) Field of Classification Search ..... 221/2, 221/21, 123, 124, 126, 129, 133, 289, 297, 221/299, 193, 194, 93, 94; 312/42, 43
See application file for complete search history.

(56) References Cited

U.S. PATENT DOCUMENTS 3,125,244 A 3/1964 Holstein
3,136,450 A * 6/1964 Carpenter ..... 221/114
3,179,289 A * 4/1965 Moyer et al. ..... 221/121
3,344,953 A * 10/1967 Merrill et al. ..... 221/75
3,433,545 A * 3/1969 Rainey ..... 312/42
3,601,237 A * 8/1971 Ovsienko ..... 194/239
3,737,071 A * 6/1973 Offutt et al. ..... 221/129
4,823,984 A * 4/1989 Ficken ..... 221/96
4,899,906 A * 2/1990 Bella ..... 221/67
5,651,476 A * 7/1997 Percy et al. ..... 221/131
6,098,839 A * 8/2000 Hunnell ..... 221/197
6,758,370 B2 * 7/2004 Cooke et al. ..... 221/194
2003/0183645 A1 * 10/2003 Shin ..... 221/133

* cited by examiner

*Primary Examiner*—David H. Bollinger
(74) *Attorney, Agent, or Firm*—Bever, Hoffman & Harms, LLP; Jeanette S. Harms

(57) ABSTRACT

An automated system for dispensing condiment packets includes a magazine for storing a stack of condiment packets and a dispenser for metering out those condiment packets. Multiple magazines and dispensers can be combined in a single condiment delivery assembly, thereby providing the means for dispensing a variety of condiment flavors. The delivery assembly can be incorporated into a fast food vending machine or can be designed as a standalone unit.

18 Claims, 10 Drawing Sheets

AUTOMATED CONDIMENT DISPENSING SYSTEM

BACKGROUND OF THE INVENTION

1. Field of the Invention

The invention relates to vending machines, and in particular, to a system and method for distributing condiments.

2. Related Art

Snack food items such as potato chips, corn chips, and pretzels are often dispensed in single-serving portions from vending machines. Such snack food items are typically consumed in the "as-dispensed" state. However, condiments (e.g., dip, salsa, ketchup, cheese) can significantly enhance the enjoyment of such snack food items. For example, potato chips are generally palatable when eaten straight from the bag. However, the same potato chips can seem much more delicious if consumed with a dip. This distinction can be important for vendors, since the better a snack food tastes, the more of that snack food consumers will purchase.

However, conventional methods for metering out snack food condiments are generally too uncontrolled or unnecessarily cumbersome. For example, condiments are commonly provided as "self-serve" items. FIG. 1 shows a standard snack food vending machine 110 from which consumers can purchase various types of snack foods 180(A), 180(B), and 180(C), visible through a window 112. A consumer inserts cash and selects one of the snack foods via a payment/selection interface 111, and an appropriate snack food package is dispensed via dispensing slot 112.

To increase consumer enjoyment of the snack food items from vending machine 110, a basket 180 of condiment packets 190 is placed next to vending machine 110. Consumers can use the condiments in condiment packets 190 to flavor their purchased snack foods. This type of "self-serve" condiment access is also common in fast food restaurants, where customers pump their own ketchup or mustard from tubs in the eating or waiting area of the restaurant.

The main benefit of self-serve condiment access is the ease with which such access can be provided. A container full of condiment packets can be placed next to existing vending machines or around fast food dining areas. Unfortunately, this type of condiment self-service is inherently wasteful, as consumers will inevitably take more of the condiment packets than they need, and non-consumers may simply take condiment packets without purchasing any associated food item.

Some fast food restaurants attempt to limit this waste by having the restaurant staff hand out condiment packets with orders. While this approach can reduce the waste associated with self serve containers and pumps, it also adds another burden to busy restaurant employees. In addition, substantial wastage may still occur, as employees simply distribute handfuls of condiment packets, rather than going through the trouble of determining how much of a condiment a particular customer really needs.

In addition, a problem associated with all conventional condiment distribution methods is that actual demand and usage can only be tracked in a very limited manner. A vendor can keep track of how many times a condiment packet container must be refilled, but cannot accurately determine how quickly the container is emptied. Similarly, the manager of a fast food restaurant can see when the condiment packets must be re-ordered, but cannot easily determine how much more popular one condiment flavor is over another.

Accordingly, it is desirable to provide a condiment dispensing system that provides efficient condiment distribution while minimizing waste.

SUMMARY OF THE INVENTION

The invention controls and monitors condiment distribution via an automated dispensing system. According to an embodiment of the invention, an automated condiment dispensing system includes a magazine for storing condiment packets and a dispenser for delivering one or more condiment packets from the magazine in response to a control signal.

According to an embodiment of the invention, the magazine holds a stack of flanged condiment packets. The magazine is mated onto the dispenser, and a pair of supports in the dispenser support the flange of the bottom-most condiment packet. Retracting one of the supports then allows the bottom-most condiment packet to drop out of the dispensing system. If the retracted support is quickly moved back into its original position, the two supports can catch the flange of the next-lowest condiment packet as it falls into the space vacated by the dispensed condiment packet.

According to another embodiment of the invention, multiple magazines and dispensers can be combined into a single dispenser assembly, thereby allowing the dispenser assembly to dispense a variety of different condiment flavors. According to an embodiment of the invention, the dispenser assembly can be incorporated into a snack food vending machine. Condiments could then be dispensed in conjunction with the purchase of snack foods, either according to a predetermined snack food-condiment association, or based on selection inputs from the purchaser.

According to another embodiment of the invention, the dispenser assembly can be incorporated into a standalone condiment vending machine. The standalone condiment vending machine can be placed in the vicinity of snack food-only vending machines, thereby allowing consumers to purchase desired condiments to use with their snack foods. The standalone condiment vending machine therefore provides a simple means for upgrading existing vending machine installations with profit-enhancing condiment delivery capability.

According to another embodiment of the invention, the dispenser assembly can be incorporated into a standalone condiment dispenser. The standalone condiment dispenser can be placed in fast food kitchens to assist fast food employees in the preparation of customer orders. The condiment dispenser beneficially eliminates manual handling of sometimes unwieldy condiment packets, and also enables more efficient usage tracking and more effective distribution metering to reduce waste.

The present invention will be more fully understood in view of the following description and drawings.

DETAILED DESCRIPTION

By providing an automated condiment packet dispensing system, the invention beneficially minimizes waste and simplifies condiment distribution. Historically, condiment packets have been flexible envelope-type containers (e.g., ketchup "squeeze packets" at fast food restaurants) that are not conducive to automated handling. However, as condiment varieties have multiplied and condiment serving sizes have increased, larger rigid condiment packets have become common.

According to an embodiment of the invention, an automated condiment dispensing system can dispense flanged condiment packets; i.e., condiment packets that include a flange (lip) that extends out from the body of the packet. The invention makes use of the fact that flanged condiment packets are relatively rigid and maintain a regular shape, and are therefore well suited for automated dispensing.

Figure 1:
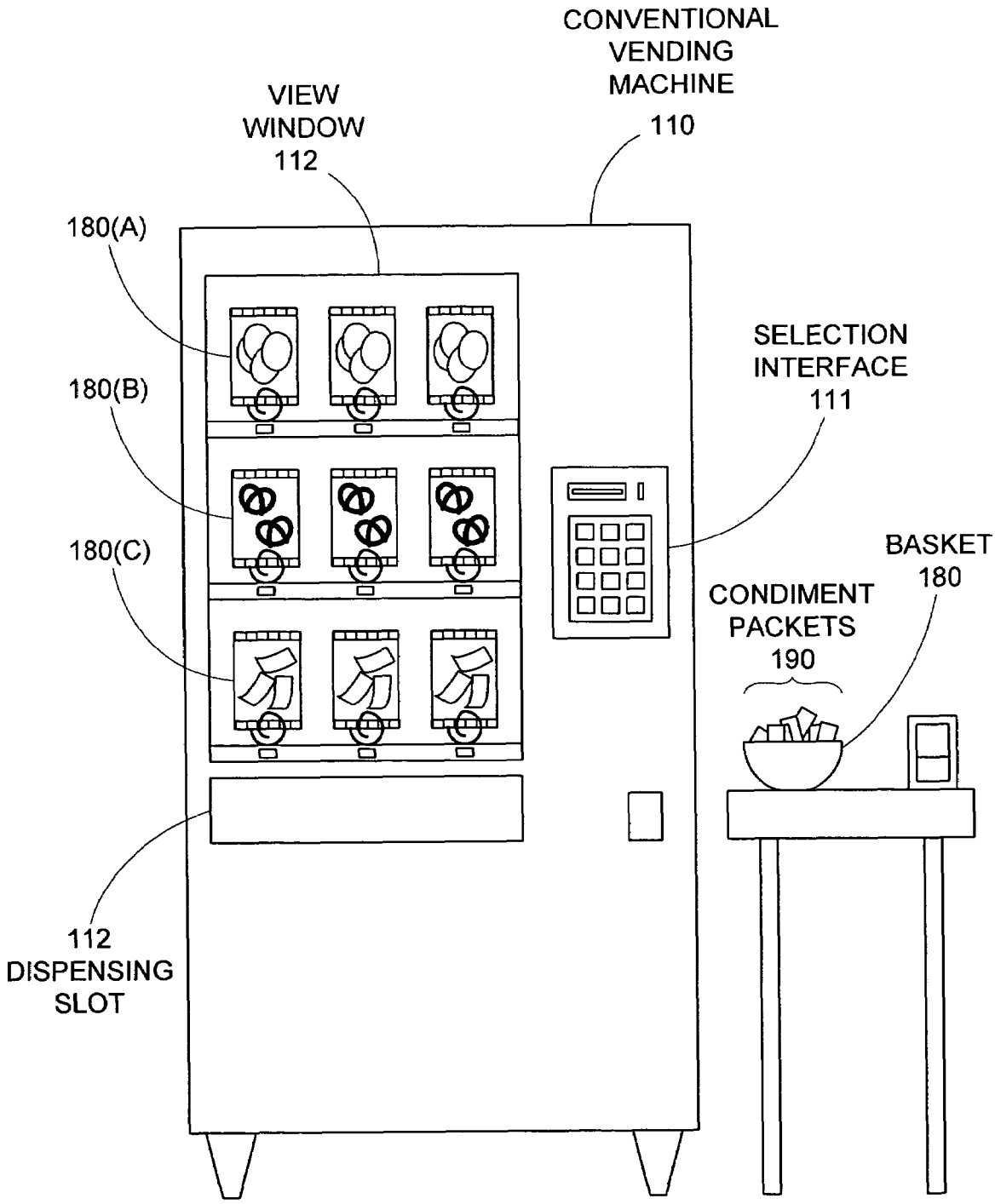
FIG. 1 (PRIOR ART)
FIG. 1 is a diagram of a conventional vending machine with a condiment supply.
Figure 2:
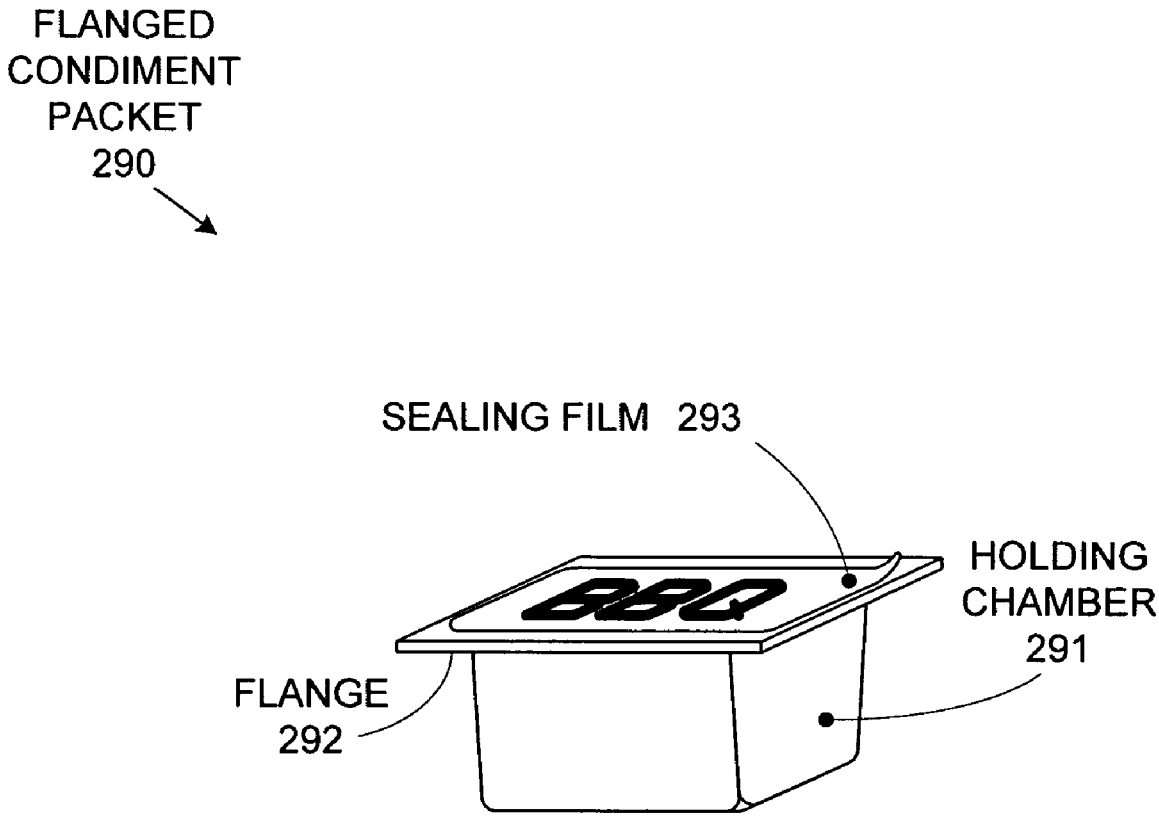
FIG. 2 is a diagram of a standard type of condiment packet.

For example, FIG. 2 shows a standard flanged condiment packet 290 that can be used with a dispensing system in accordance with an embodiment of the invention. Condiment packet 290 is substantially similar to the "One Ounce Cup" from Portion Pack, Inc., which is similar to the type of packet used in fast food restaurants for dipping-sauce-type condiments, such as honey mustard sauce and barbeque (BBQ) sauce for fried chicken strips, ketchup for french fries, jellies for toast, any many other condiments, including ranch dressing, salsa picante, mayonnaise, and mustard.

Condiment packet 290 includes a holding chamber 291 and a flange 292 extending outward in a roughly perpendicular direction from the top (opening) of holding chamber 291. A sealing film 293 is attached to the flat surface provided by flange 292, thereby sealing the condiment within holding chamber 291. Note that for exemplary purposes, the operation of the invention is described with respect to a flanged condiment packet such as packet 290 that includes a substantially planar flange. However, the invention can accommodate condiment packets (or even packets for non-condiment items such as candy, toys, or health and hygiene products) having any type of flange geometry (e.g., the small rounded flange of coffee creamer packets).

Figure 3A:
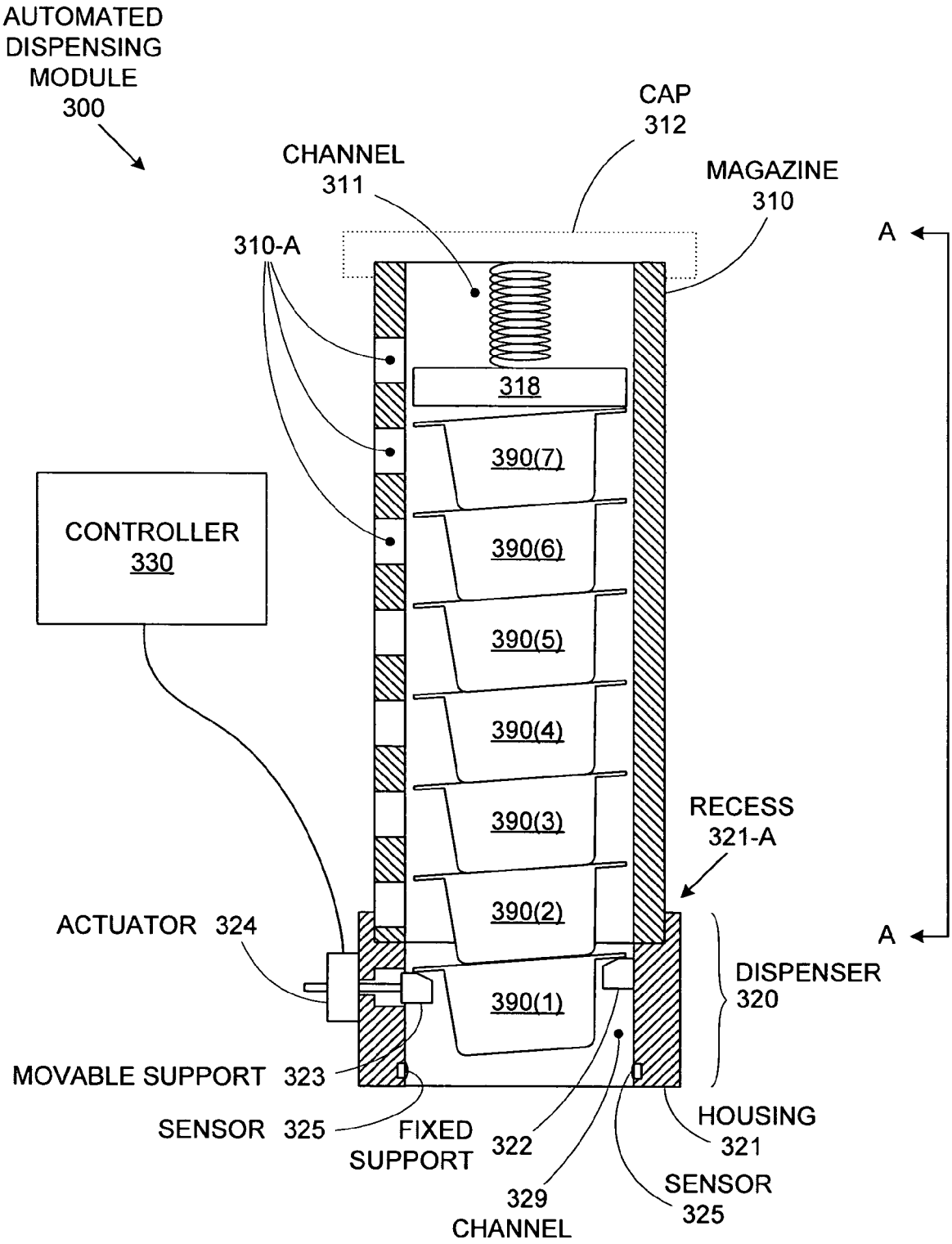
FIG. 3A is a diagram of an automated dispensing module for condiment packets, according to an embodiment of the invention.

FIG. 3A shows a cross-section of an automated condiment dispensing module 300, in accordance with an embodiment of the invention. Dispensing module 300 includes a magazine 310, a dispenser 320, and a controller 330. Magazine 310 stores a stack of condiment packets 390 (i.e., condiment packets 390(1)-390(7)), and feeds those condiment packets 390 to dispenser 320. Dispenser 390 then dispenses condiment packets 390 in response to control signals from controller 330. Controller 330 itself can respond to external control signals, such as from a vending machine input panel, external sensors, or a cash register, as described in greater detail below.

Magazine 310 defines a channel 311 having a cross-section that is slightly larger then, but substantially congruent to, the flange outline of a condiment packet 390. For example, by sizing the cross section of channel 311 to be just larger (e.g., 0.05-0.125 inches) than the flange dimension of condiment packets 390, magazine 310 can maintain condiment packets 390 in a desired arrangement, while still allowing free movement of those condiment packets within channel 311. For example, according to an embodiment of the invention, channel 311 can have 2.365 in. by 1.800 in. cross section to accommodate the 2.25 in. by 1.75 in. flange dimensions of the "One Ounce Cup" condiment packet from Portion Pack, Inc. (i.e., condiment packet 290 shown in FIG. 2).

According to various embodiments of the invention, magazine 310 can comprise plastic, metal, or any other substantially rigid material, and can be created via extrusion, forming, molding, machining, assembly, or any other manufacturing process. Note that while magazine 310 is depicted with solid walls for exemplary purposes, magazine 310 can comprise any structure that constrains condiment packets 390 to move within channel 311. For example, according to an embodiment of the invention, magazine 310 can include a transparent portion, such as a series of viewing ports 310-A that run the length of magazine 310. Viewing ports 310-A can be cutouts or clear glass or plastic windows that allow an operator to view condiment packets 390 within magazine 310. For even greater convenience, viewing ports 310-A can be sequentially numbered to allow the operator to determine exactly how many condiment packets 390 are present in (or have been dispensed from) magazine 310.

According to another embodiment of the invention, magazine 310 can comprise an optional cap 312 for closing an end of magazine 310. Cap 312 can, for example, be used to prevent dust and other foreign materials from entering magazine 310. According to another embodiment of the invention, cap 312 can provide a fixed mounting surface for an optional spring-loaded platform 318 that pushes condiment packets 390 into dispenser 320, thereby allowing automated dispensing module 300 to be positioned in non-vertical orientations. Note that various other pushing mechanisms will be readily apparent. For example, optional platform 318 could simply comprise a weighted platform that provides additional ejection force when magazine 310 is oriented substantially vertically.

Figure 3B:
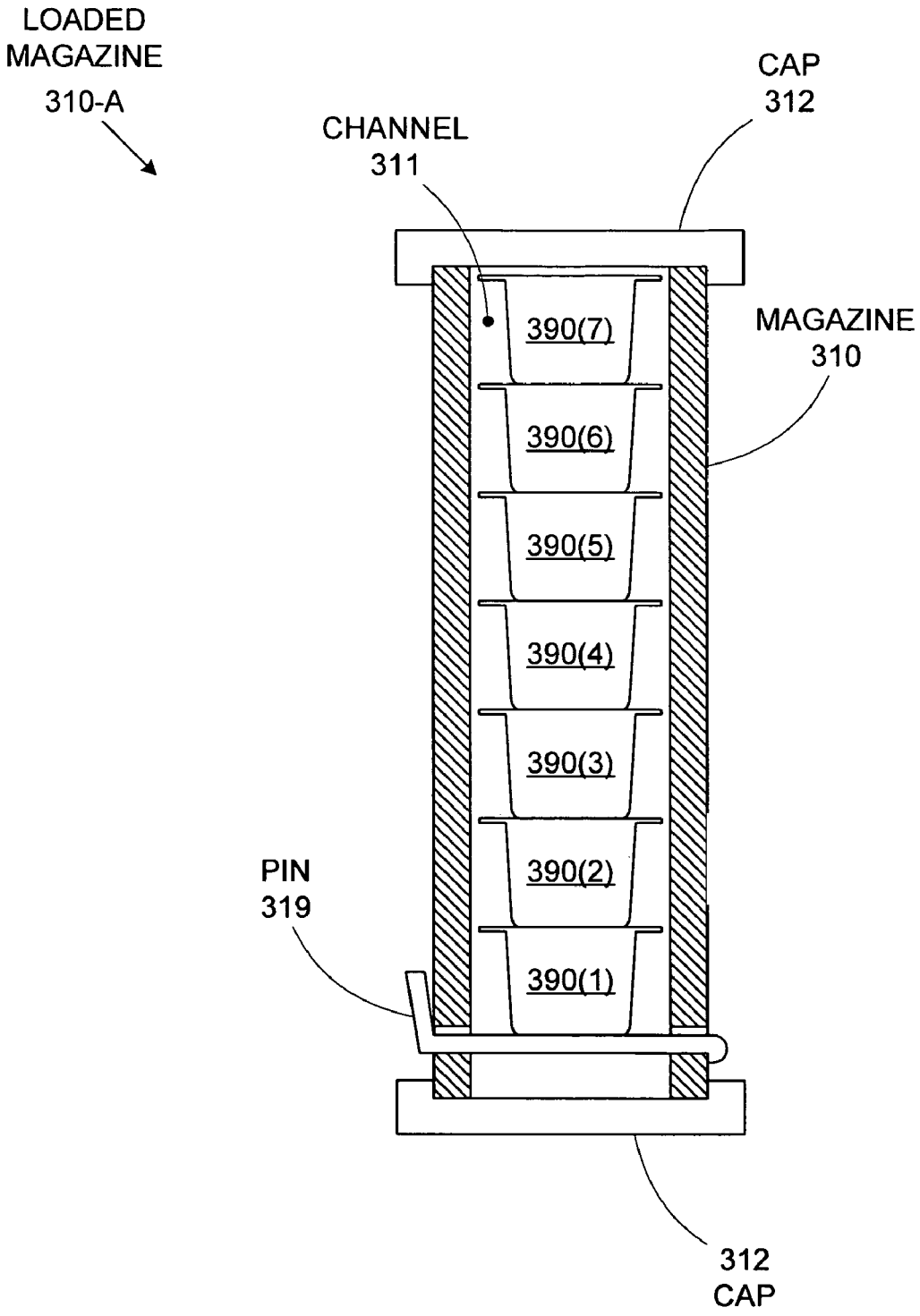
FIG. 3B is a diagram of a loaded condiment packet magazine, according to an embodiment of the invention.

According to another embodiment of the invention, by making cap 312 removable, magazine 310 can be used as a condiment packet transport container. For example, FIG. 3B shows magazine 310 in a loaded configuration (view A-A from FIG. 3A). A supplier could fill magazine 310 with condiment packets 390 at a supply location (e.g., factory) and then affix caps 312 at both ends of magazine 310 to secure condiment packets 390 for shipping. Upon receipt, the operator of automated dispensing module 300 would remove at least the cap at the bottom of magazine 310 and insert magazine 310 into dispenser 320.

Note that according to an embodiment of the invention, a supplemental support mechanism (such as a pin 319) could be used to support condiment packets 390 within magazine 310 even after lower cap 312 is removed. Then, once magazine 310 is inserted into dispenser 320 (as shown in FIG. 3A), pin 319 can be removed to allow condiment packets 390 to be fed into dispenser 320.

Returning to FIG. 3A, dispenser 320 includes a housing 321, a fixed support 322, a movable support 323, and an actuator 324. Housing 321 is a substantially rigid structure that includes a recess 321-A that interfaces with magazine 310, so that condiment packets 390 in magazine 310 can be fed into a channel 329 defined by the walls of housing 321. According to an embodiment of the invention, channel 329 simply continues channel 311 defined by magazine 310 (i.e., channel 329 has the same cross-sectional dimensions as channel 311).

According to another embodiment of the invention, dispenser 320 can also include sensor(s) 325 for tracking the quantity of condiment packets 390 dispensed. Sensors 325 can increment a counter each time the passage of a condiment packet 390 is detected. Note that according to another embodiment of the invention, sensors 325 could be placed higher in housing 321 to detect the presence of a condiment packet, indicating that automated condiment dispensing module 300 is in a "ready to dispense" state.

Fixed support 322 is affixed to a wall of housing 321 and extends into channel 329. Movable support 323 is attached to actuator 324 and can be extended into, or retracted from, channel 329. When extended into channel 329, movable support works with fixed support 322 to provide ledge structures that support the flange of the lowermost condiment packet 390 (condiment packet 390(1) in FIG. 3A). When actuator 324 retracts movable support 323 from channel 329, condiment packet 390(1) is dispensed from housing 321. Actuator 324 can then quickly re-extend movable support back into channel 329 to catch and support the flange of condiment packet 390(2), thereby readying dispenser 320 for the next dispensing operation. Note that according to various other embodiments of the invention, other types of dispensing mechanisms (e.g., flappers, gates, or ejection devices) could be used to dispense condiment packets 390 from dispenser 320.

According to an embodiment of the invention, actuator 324 can comprise a solenoid controlled by a microcontroller in controller 330 too ensure reliable dispensing of a single condiment packet 390 during each dispense cycle (i.e., movable support 323 retraction and re-extension). Such a configuration can provide actuation times in the 200 ms or less range, which would cause movable support 323 to be retracted just long enough to allow the flange of the lowest condiment packet 390 (e.g., condiment packet 390(1)) to drop below movable support 323, thereby ensuring that the re-extension of movable support 323 into chamber 329 catches the flange of the second lowest condiment packet 390 (e.g., condiment packet 390(2)). However, while a microprocessor-controlled solenoid is described for exemplary purposes, actuator 324 and controller 330 can comprise any type of high-speed actuation mechanism.

According to another embodiment of the invention, the dispensing reliability of automated dispensing module 300 can be further improved by offsetting the support surfaces of fixed support 322 and movable support 323 (i.e., the surfaces of fixed support 322 and movable support 323 on which the flange of condiment packet 390 rests when movable support 323 is fully extended into channel 329). FIG. 3A shows the support surface of movable support 323 being lower than the support surface of fixed support 322. As a result, the stacked condiment packets 390 in magazine 310 are all canted slightly towards movable support 323, which in turn ensures a consistent drop motion during a dispense operation (i.e., each time movable support 323 is retracted, the motion of the lowest condiment packet 390 as it exits housing 321 is the same). This consistent drop motion is depicted in FIGS. 3C and 3D.

Figure 3C:
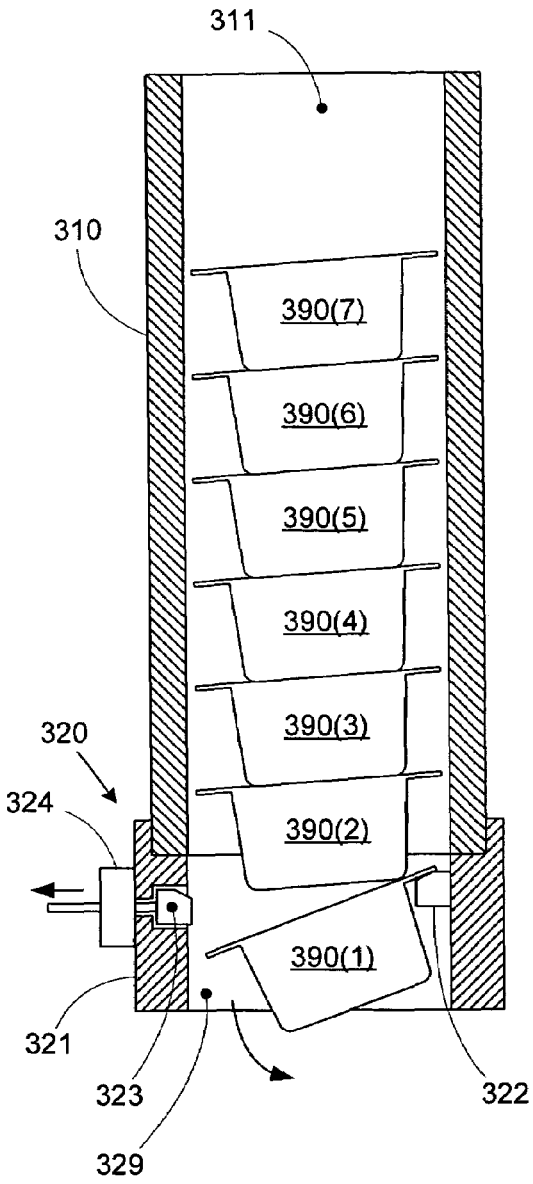
FIGS. 3C-3D are diagrams of the dispensing action of the automated dispensing module shown in FIG. 3A.
Figure 3D:
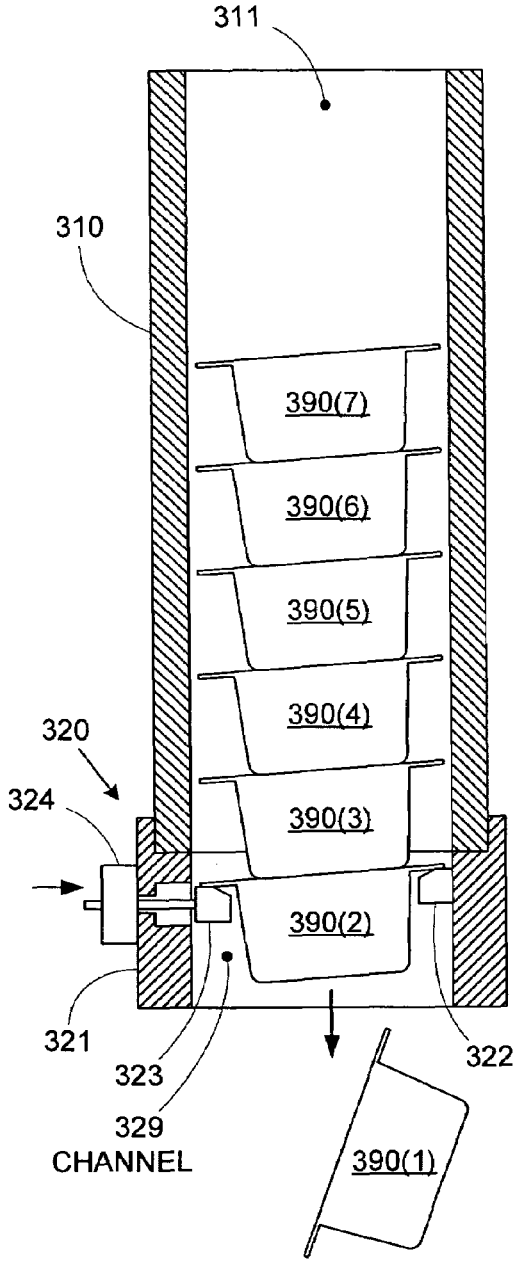

FIG. 3C shows the motion of the lower-most condiment packet (390(1)) just after movable support 323 is retracted from channel 329 by actuator 324. Once the flange of condiment packet 390(1) is no longer supported by movable support 323, condiment packet 390(1) immediately pivots downwards around fixed support 322, and eventually drops out of channel 329, as shown in FIG. 3D. Meanwhile, actuator 324 re-extends movable support back into channel 329 to catch the flange of condiment packet 390(2), thereby preparing automated condiment dispenser 300 for a subsequent dispense operation. Note that according to various other embodiments of the invention, the length of time that movable support 323 is retracted from channel 329 can be adjusted to allow multiple condiment packets 390 to be dispensed during a single dispense operation.

Figure 4A:
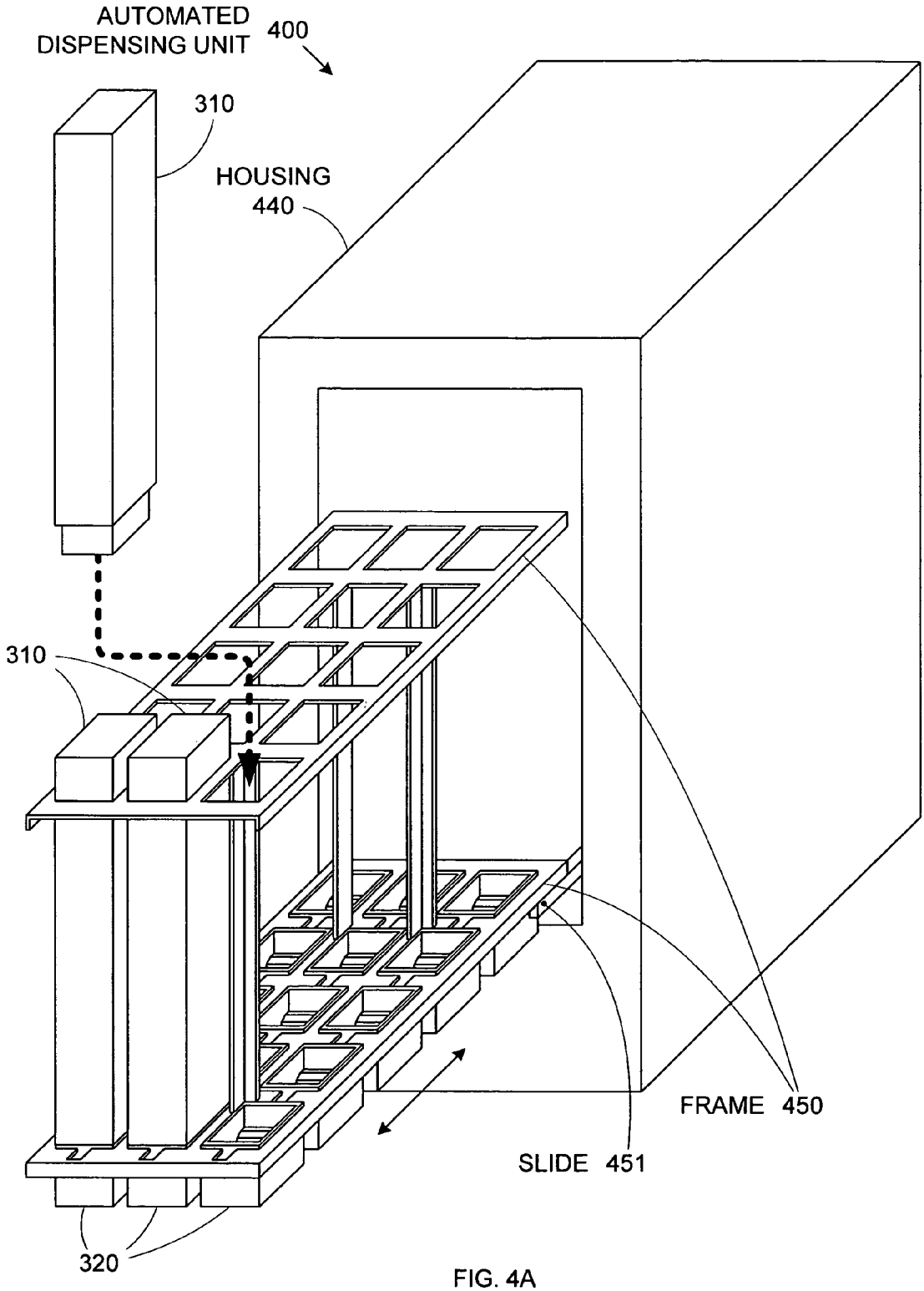
FIGS. 4A-4B are diagrams of an automated dispensing system for condiment packets that incorporates the automated dispensing module of FIG. 3A, according to an embodiment of the invention.

FIG. 4A shows an automated dispensing unit 400 for combining multiple dispensers 320 and multiple magazines 310 (e.g., having different condiment flavors/types) in a single assembly, in accordance with another embodiment of the invention. Automated dispensing unit 400 includes a housing 440 to which a frame 450 is attached. Multiple dispensers 320 are mounted in frame 450, and corresponding slots in frame 450 allow magazines 310 to be inserted and mated with dispensers 320. According to an embodiment of the invention, frame 450 can be coupled to housing 440 via a slide mechanism 451 that allows frame 450 to slide in and out of housing 440, thereby simplifying the insertion and removal of magazines 310.

Figure 4B:
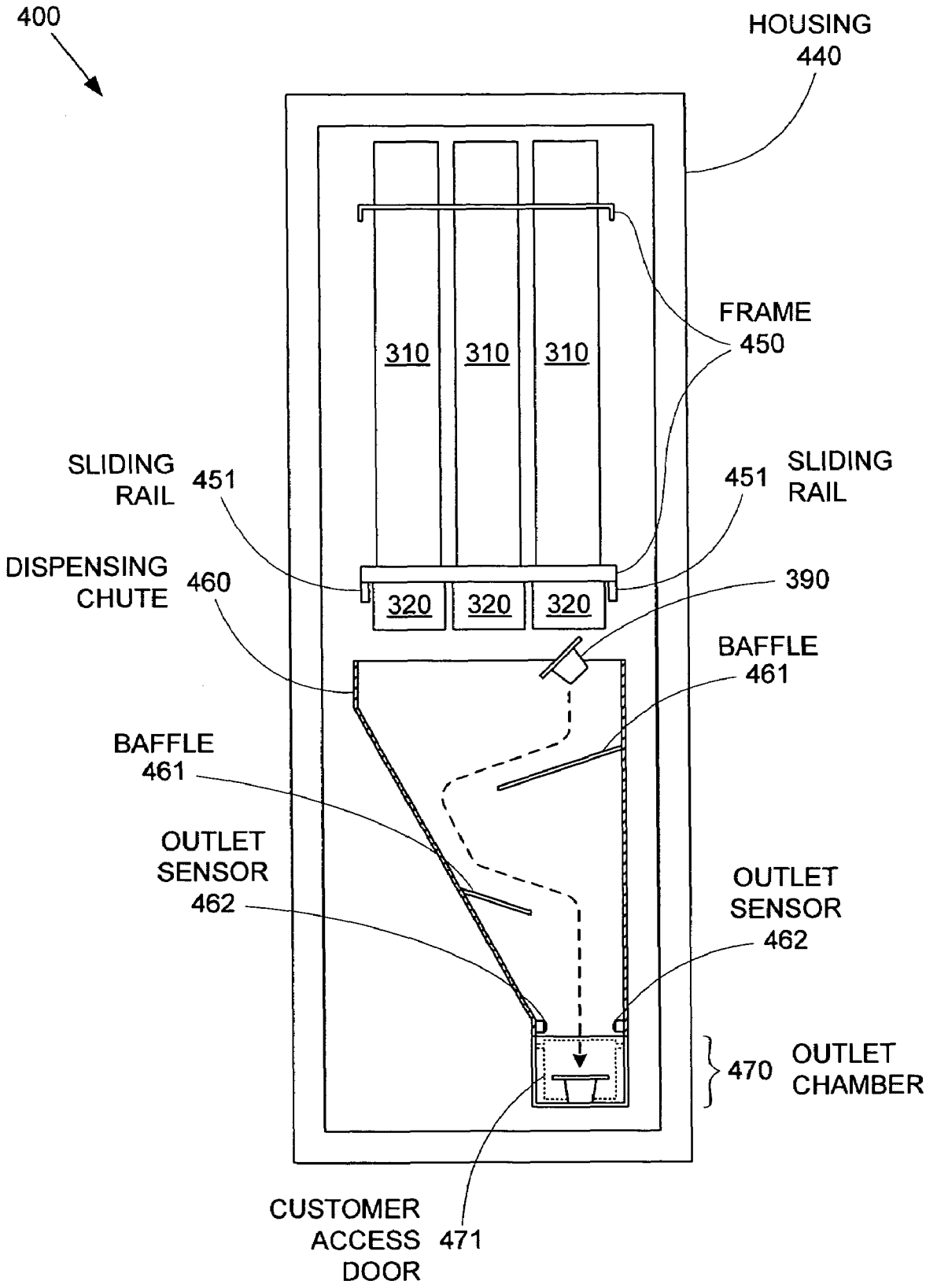

According to another embodiment of the invention, automated dispensing unit 400 can include guide structures for transporting dispensed condiment packets to a desired location. For example, FIG. 4B shows a front view of automated dispensing unit 400 with an optional dispensing chute 460 positioned under frame 450, according to an embodiment of the invention. Dispensing chute 460 guides condiment packets 390 that are dispensed from dispensers 320 into an output chamber 470, where those condiment packets 390 can be picked up by the condiment pack requester.

According to an embodiment of the invention, dispensing chute 460 can be attached to frame 450, so that proper alignment with dispensers 320 can be easily maintained. According to another embodiment of the invention, dispensing chute 460 can be rigidly fixed to housing 440 (or even an structure external to housing 440), thereby providing enhanced access to dispensers 320 and magazines 310 when frame 450 is slid out from housing 440.

According to another embodiment of the invention, dispensing chute 460 can include one or more internal baffles 461 that define a non-linear path to output chamber 410 for condiment packets 390 that are dispensed into dispensing chute 460. By breaking the fall of condiment packets 390 as they drop from dispensers 320 (rather than allowing condiment packets 390 to fall directly into outlet chamber 410), baffles 461 reduce the maximum impact felt by those condiment packets 390, thereby reducing the chance of condiment leakage.

According to another embodiment of the invention, dispensing chute 460 can include an outlet sensor 462 at the interface to outlet chamber 470. Outlet sensor 462 can be used to confirm that a condiment packet 390 has been properly dispensed, and/or can be used to keep track of how many condiment packets 390 have been dispensed. According to an embodiment of the invention, outlet chamber 470 can include a customer access door 471 that swings inward, thereby allowing someone to reach in to outlet chamber 470 to remove a condiment packet 390, but at the same time preventing that person from interfering with or damaging outlet sensor 462.

Figure 5A:
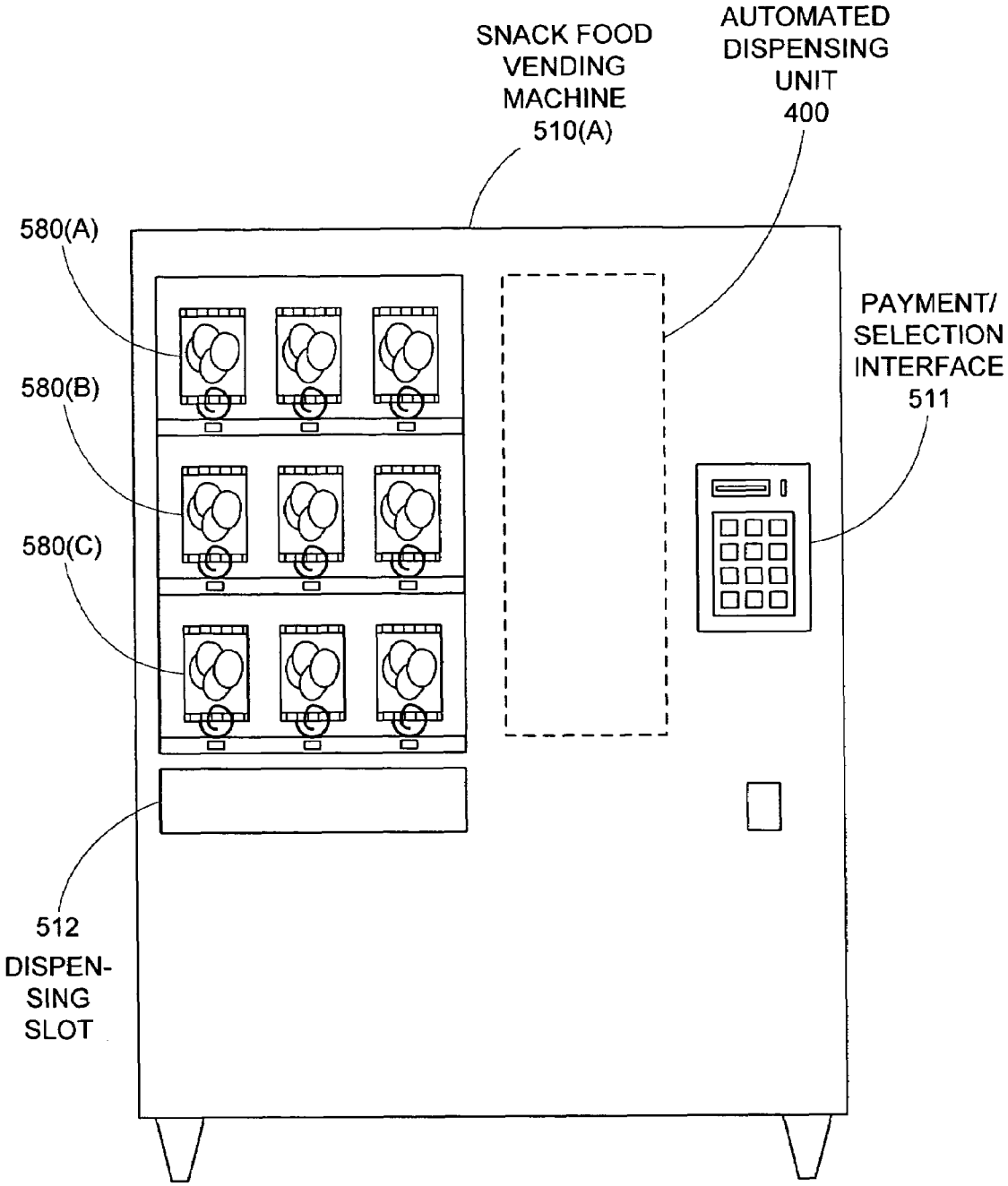
FIGS. 5A-5D are illustrations of various systems in which the automated dispensing system of FIG. 4 can be incorporated, according to various embodiments of the invention.

Automated dispensing unit 400 can be incorporated into various types of dispensing systems to provide condiment dispensing functionality in a variety of situations. For example, as indicated in FIG. 5A, automated dispensing unit 400 can be integrated into a snack food vending machine 510(A) that dispenses snack foods 580(A), 580(B), and 580(C). Then, upon receipt of payment and selection of a desired snack food type at a payment/selection interface 511 (e.g., a standard cash or smart card interface with selection buttons), an appropriate condiment packet (not shown) would be dispensed at a dispensing slot 512 with the selected snack food 580(A), 580(B), or 580(C). Alternatively, selection interface 511 could allow for direct selection of the type of condiment to be dispensed with the snack food purchase, or could even allow condiment packets 390 to be purchased without any accompanying snack food purchase.

Note that because automated dispensing unit 400 can provide a variety of condiment types, the number of different snack foods that must be provided by vending machine 510(A) can beneficially be reduced. For example, by providing a different dip flavors (e.g., sour cream and onion, nacho cheese, ranch, and guacamole), snack foods 580(A), 580(B), and 580(C) could all be the same type of snack food (e.g., a plain potato chip), thereby simplifying the stocking requirements for snack food vending machine 510(A).

Note further that the self-contained nature of automated dispensing unit 400 enables relatively simple integration into snack food-only vending machine designs. For example, according to an embodiment of the invention, automated dispensing unit 400 can be integrated into an on-demand system for frying and dispensing hot food product, such as described in U.S. Pat. No. 5,069,116, issued Dec. 3, 1991 to Marquez et al., and U.S. Pat. No. 5,052,288, issued Oct. 1, 1991 to Marquez et al. Snack food vending machine 510(A) could then provide freshly fried chips on demand with a selected flavoring condiment, such as BBQ sauce, salsa, cheese, and ketchup, among others.

Figure 5B:
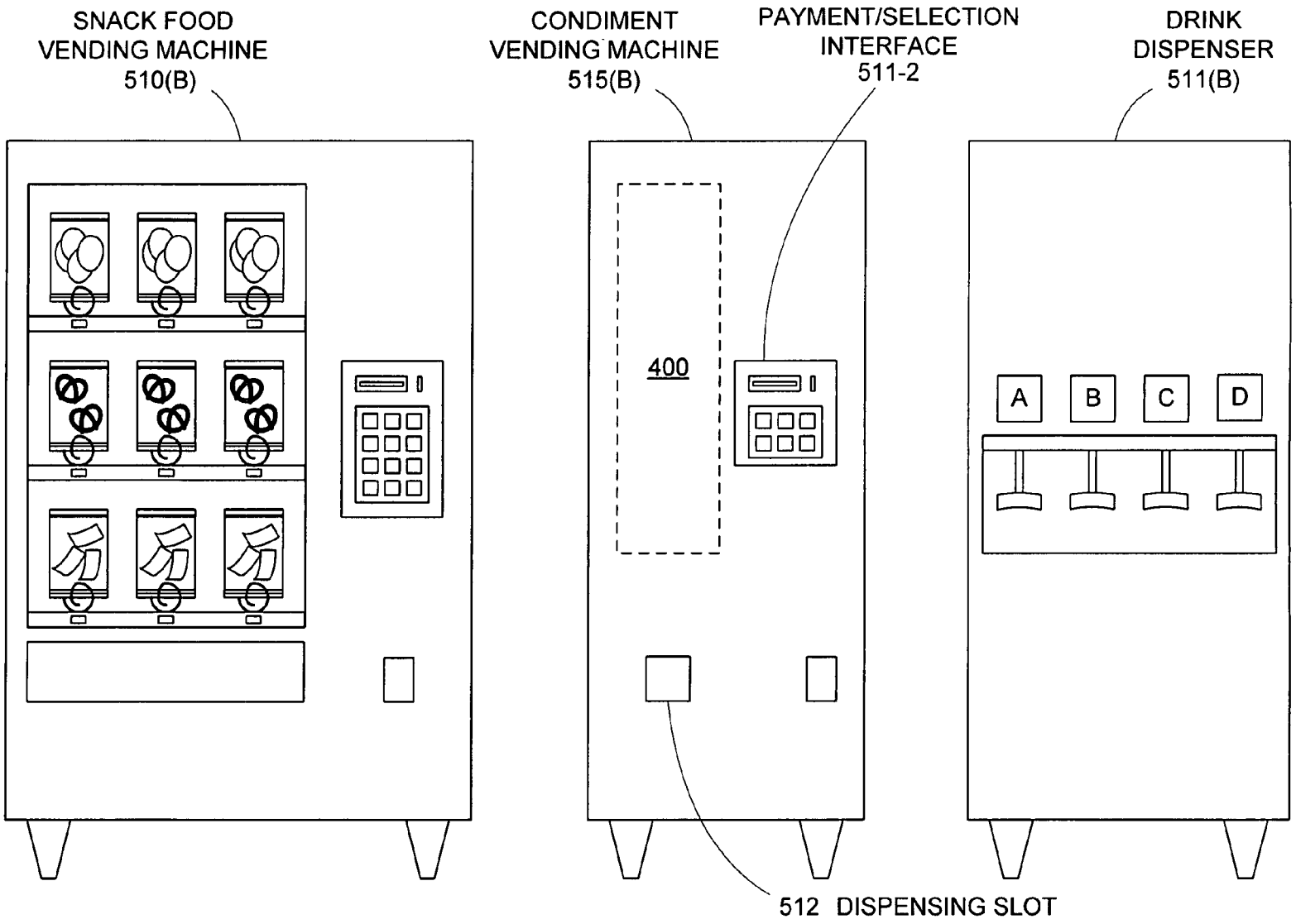

Alternatively, automated dispensing unit 400 can be incorporated into standalone condiment systems. For example, FIG. 5B shows a condiment vending machine 515(B), in accordance with another embodiment of the invention. Condiment vending machine 515(B) includes automated dispensing unit 400 and a selection interface 511-2 that allows a consumer to purchase a desired condiment packet 390 (not shown).

Condiment vending machine 515(B) can, for example, be deployed next to existing snack food-only vending machines, such as snack food vending machine 510(B). By increasing supplemental revenue (through condiment purchases in conjunction with snack food purchases) and increasing total sales (by enhancing the appeal of snack foods), condiment vending machine 515(B) can provide a simple, yet profitable retrofit to existing vending machine installations.

Condiment vending machine 515(B) can alternatively be deployed in restaurants, fast food establishments, food courts, or any other food service location where condiment self-service would be a benefit. For example, condiment vending machine 515(B) could be placed adjacent to a drink dispenser 511(B) in a fast food restaurant, thereby-allowing customers to purchase condiments as desired, and freeing restaurant staff from the task of handing out condiment packets to individual customers.

Figure 5D:
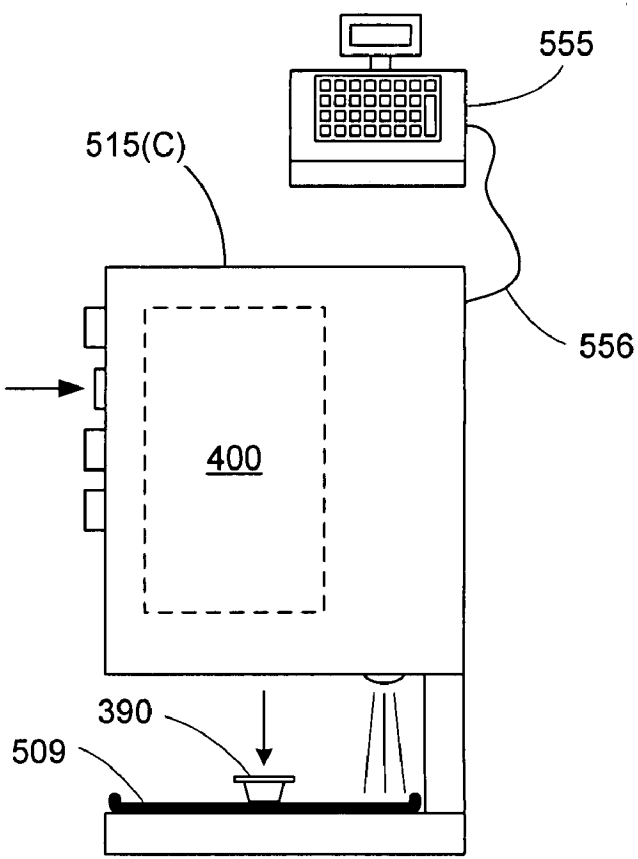
Figure 5C:
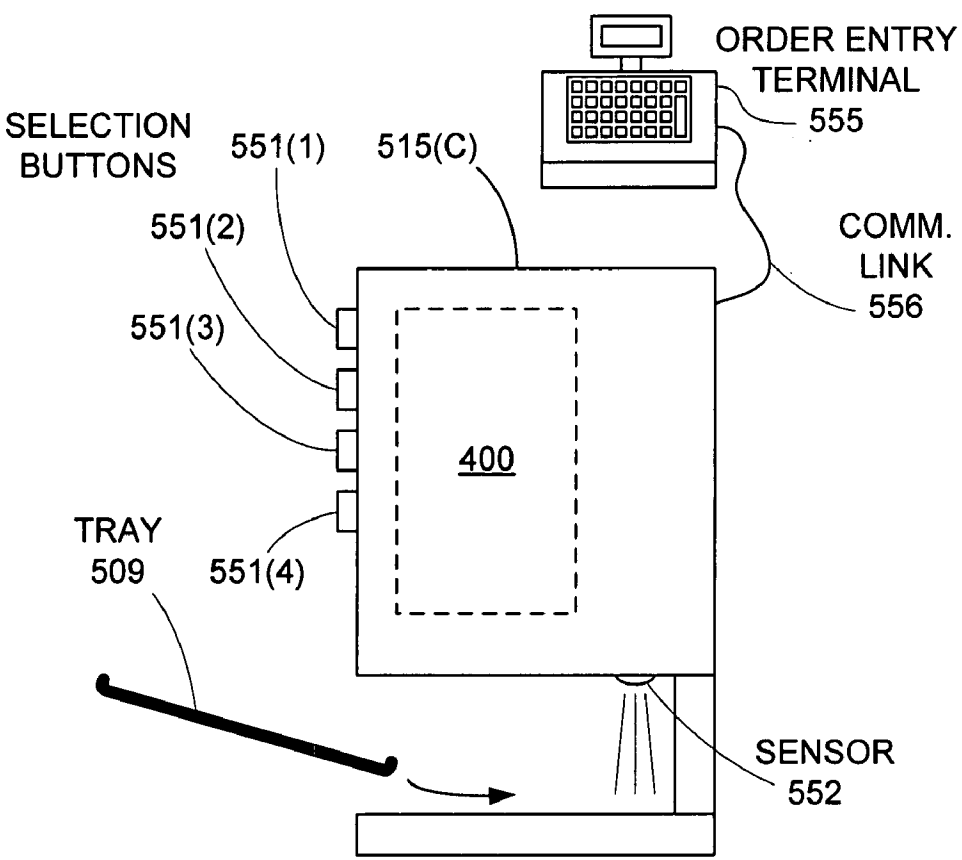

FIGS. 5C and 5D show a "desktop" condiment dispensing system 515(C) that can be used in food dispensing environments such as fast food restaurants, food courts, and any other locations where packetized condiment dispensing is common. Condiment dispensing system 515(C) includes automated dispensing unit 400 (as described with respect to FIGS. 4A and 4B), but does not include a payment interface, since it is designed for use in situations where payment is not required (e.g., a fast food worker gathering an order, or a food court patron loading their food tray).

According to an embodiment of the invention, condiment dispensing system 515(C) includes a selection interface, such as selection buttons 551(1)-551(4) that allow a user to choose a particular condiment flavor. Alternatively, the condiment flavor could be specified from a remote order entry terminal 555 (e.g., a cash register or selection terminal) via a communications link 556 (e.g., a wired or wireless network). In this manner, condiment dispensing system 515(C) can be part of an "order fill" system that automatically places the items ordered by a customer onto a tray 509, thereby ensuring accurate assembly of the customer order.

According to another embodiment of the invention, condiment dispensing system 515(C) can include a sensor 552 for automatically detecting when to dispense a condiment packet 390. As indicated in FIGS. 5C and 5D, when sensor 552 detects the presence of tray 509 in an appropriate position, it instructs automated dispensing unit 400 to dispense a condiment packet 390 onto tray 509. This auto-detect capability can further streamline the order fill operation described above.

Although the present invention has been described in connection with several embodiments, it is understood that this invention is not limited to the embodiments disclosed, but is capable of various modifications that would be apparent to one of ordinary skill in the art. For example, while a gravity feed system is described with respect to automated condiment dispensing module 300 shown in FIGS. 3A-3C, magazine 310 can include a spring-loaded mechanism to eject condiment packets 390 from magazine 310. Furthermore, in conjunction with a spring-loaded mechanism, magazine 310 could store condiment packets 390 in a substantially horizontal channel. Thus, the invention is limited only by the following claims and their equivalents.

The invention claimed is:

1. A system for dispensing food products, the system comprising:

a first dispenser defining a first output channel;

a first magazine for feeding a first set of rigid condiment packets to the first dispenser; and a controller for sending a first control signal to the first dispenser, the first control signal instructing the first dispenser to dispense a first specified quantity of the first set of rigid condiment packets from the first output channel, wherein each of the rigid condiment packets comprises a flange having a flange outline, wherein the first magazine defines a first guide channel having a first cross-sectional area, the first cross-sectional area being larger than and substantially congruent to the flange outline, and wherein the first dispenser comprises:

a first fixed support extending into the first output channel for supporting a first portion of the flange of a selected condiment packet;

a first movable support; and a first actuator for extending and retracting the first movable support into and from, respectively, the first output channel in response to the first control signal, wherein when the first movable support is extended, the first movable support supports a second portion of the flange of the selected condiment packet.

2. The system of claim 1, wherein the first actuator comprises a solenoid, and wherein the controller comprises a microcontroller for providing an actuation signal to the solenoid in response to the first control signal.

3. The system of claim 1, wherein the first guide channel is oriented to store the first set of condiment packets in a stack above the first output channel, and wherein when the first movable support is extended, a support surface of the first movable support is lower than a support surface of the first fixed support.

4. The system of claim 3, wherein the first magazine is removable from the system.

5. The system of claim 4, wherein the first magazine comprises at least one wall for defining the first guide channel, and wherein the at least one wall includes a transparent portion for viewing the first set of rigid condiment packets.

6. The system of claim 3, further comprising an output chute below the first dispenser for guiding a dispensed condiment packet from the first dispenser to an output chamber, the output chute comprising at least one baffle for breaking the fall of the dispensed condiment packet.

7. The system of claim 6, wherein the output chute further comprises a sensor for monitoring passage of the dispensed condiment packet into the output chamber.

8. The system of claim 1, further comprising:

a second dispenser defining a second output channel;

a second magazine for feeding a second set of rigid condiment packets to the second dispenser, wherein the controller sends a second control signal to the second dispenser to instruct the second dispenser to dispense a second specified quantity of the second set of rigid condiment packets from the second output channel.

9. The system of claim 8, further comprising a selection interface for receiving a selection input, wherein the controller sends the first control signal or the second control signal to the first dispenser or the second dispenser, respectively, based on the selection input.

10. The system of claim 9, further comprising a payment interface for receiving payment, wherein the controller sends the first control signal or the second control signal to the first dispenser or the second dispenser, respectively, in response to the payment.

11. A system for dispensing food products, the system comprising:

a condiment dispenser defining an output channel;

a magazine for feeding sets of rigid condiment packets to the condiment dispenser; and a food dispensing mechanism for dispensing a serving from a set of snack foods in response to a payment and a selection input; and a controller for sending at least one control signal to the food dispensing mechanism and the condiment dispenser based on a selection input of a snack food, wherein the at least one control signal directs the food dispensing mechanism to dispense the serving and directs the condiment dispenser to dispense a first quantity of the set of rigid condiment packets from the output channel.

12. The system of claim 11, wherein the set of snack foods consists of a single type of snack food, wherein each of a first set of condiment packets contains a first condiment flavor, and wherein each of a second set of condiment packets contains a second condiment flavor, the second condiment flavor being different from the first condiment flavor.

13. The system of claim 9, wherein the selection input is provided by a remote order entry terminal.

14. The system of claim 1, wherein the first magazine comprises means for pushing the first set of condiment packets towards the first dispenser.

15. A snack food vending machine comprising:

a payment interface;

a selection interface;

means for storing a plurality of snack food items;

means for storing a plurality of condiment packets; and means for automatically dispensing a serving of the plurality of snack food items and at least one of the plurality of condiment packets in response to a payment at the payment interface and a selection input at the selection interface.

16. The snack food vending machine of claim 15, wherein the plurality of condiment packets includes a plurality of condiment flavors, and wherein the condiment flavor in the at least one of the plurality of condiment packets is based on the selection input.

17. The snack food vending machine of claim 16, wherein the plurality of snack food items consists of a single snack food type.

18. The snack food vending machine of claim 15, wherein the means for storing the plurality of condiment packets comprises a plurality of removable magazines, wherein each of the plurality of magazines holds a set of condiment packets having a single condiment flavor.

* * * * *